US005380984A

United States Patent [19]

Yamamura et al.

[11] Patent Number: 5,380,984

[45] Date of Patent: Jan. 10, 1995

[54] HEATER DEVICE OF CIGARETTE LIGHTER AND METHOD OF MANUFACTURING THE SAME

[75] Inventors: Tetsuo Yamamura; Seiichi Murakami; Manabu Sato, all of Tokyo, Japan

[73] Assignees: Yumedia Co., Ltd.; Ceramic Industrial Co., Ltd., both of Tokyo, Japan

[21] Appl. No.: 65,621

[22] Filed: May 21, 1993

[30] Foreign Application Priority Data

May 22, 1992 [JP] Japan ..... 4-154083
May 17, 1993 [JP] Japan ..... 5-136982

[51] Int. Cl.[6] ..... H05B 3/16
[52] U.S. Cl. ..... 219/270
[58] Field of Search ..... 219/260–270

[56] References Cited

U.S. PATENT DOCUMENTS 851,218 4/1907 Bessel ..... 219/267
972,811 10/1910 Burnett ..... 219/263
1,525,624 2/1925 Suter ..... 219/270
2,689,902 9/1954 Burtman ..... 219/268 X
3,351,736 11/1967 Jacobson ..... 219/267
3,392,265 7/1968 King et al. ..... 219/268
3,419,705 12/1968 Gordon ..... 219/270
4,733,056 3/1988 Kojima et al. ..... 219/270 X

*Primary Examiner*—Teresa J. Walberg
*Attorney, Agent, or Firm*—Ostrolenk, Faber, Gerb & Soffen

[57] ABSTRACT

A heater device of a cigarette lighter comprises a board having an insulation properties together with heat resistance and fire resistance, and a plurality of heaters arranged on the periphery of the surface of said board abutting with a cigarette in a manner to be positioned in correspondence with the paper portion of the cigarette, said heaters being connected in series to each other.

Thereby the object of the present invention which is to enhance the cigarette lighting ability of a cigarette lighter having a plurality of heaters generating heat by the use of dry batteries as a power source, and to obtain a cigarette lighter which is safe and easy to light a cigarette can be solved.

3 Claims, 4 Drawing Sheets

HEATER DEVICE OF CIGARETTE LIGHTER AND METHOD OF MANUFACTURING THE SAME

BACKGROUND OF THE INVENTION

1. Field of the Invention

The present invention relates to a heater device of a portable cigarette lighter using a lighting system in which a cigarette which is allowed to come proximately in contact with the lighter is lit by the heat generated by heaters connected to dry batteries cells as a power source, and relates to a method of manufacturing the heater device.

2. Background Art

Heretofore, such cigarette lighters have included gas lighters and oil lighters using gas and oil as a fuel, respectively. The systems for lighting these fuels, in particular, gas fuels (such as butane gas bottled at a high pressure) include the flint system, the piezoelectric system, and the system of generating a spark using batteries as a power source. These cigarette lighters have a problem in that a flame is allowed to develop by lighting a fuel (in a vaporized state), so that flame may be difficult to develop because of wind and the like when they are used outdoors. Therefore, some systems use a grill-shaped heater which is provided in a hood to protect the flame from wind and to make it stable, and to improve the cigarette lighting ability, thereby heating the heater by the flame from the inside of the hood.

These cigarette lighters, which fill the fuel supply with butane gas pressurized and liquified at a high pressure and use the gas as a fuel as previously described, have the associated danger of flammability at all times. They employ a structure in which a fuel at a high pressure is sealed by a nozzle or a sealer, so that the fuel might blow out from a very narrow gap which develops in the nozzle or sealer, and that blown out fuel is apt to catch fire to cause a burn. On the other hand, in these portable cigarette lighters, when a fuel supply is used up, it is necessary to discard the lighter itself and purchase another, while in those lighters employing a structure into which fuel ca be filled, providing such a fuel filling structure might increase their product cost, and cause the fuel gas to be apt to diffuse in the air when the fuel supply is refilled.

Therefore, the present applicant previously proposed a safe cigarette lighter which uses no fuel (see Japanese Utility Model Application Nos. 1-133531, 3-34701). The cigarette lighter has a composition in which heaters are connected through a switching section to a power source section comprising dry cell batteries, and when the switching section is closed, a closed circuit is formed to cause the heaters to generate heat, providing a portable compact lighter in which a cigarette which has been allowed to come proximately in contact with the lighter is lit by the heat generated by the heaters, and the circuit uses two small-size batteries suitable for carrying such as R6 size (AA size), R03 size (AAA size) and R1 size (N size) batteries as dry cell batteries in the power source section.

In the aforementioned cigarette lighters using no fuel, it has been desired to improve the cigarette lighting ability. In these cigarette lighters, one heater has been arranged in correspondence with tobacco for the head of a cigarette inserted through the inserting port of a casing, thereby causing inferior lighting ability and thus a flame been hardly developed.

Therefore, although an attempt has been made to increase the number of conventional heaters, to connect them in parallel to each other, and then to connect them to their power source, the heat generating state of each heater has become worse such that each heater has not become red-hot, this is unlike the case where one heater has been used. Further, the lighting ability has been deteriorated, and the power supply condition has not been checked visually, causing the life of the battery cell to be considerably shortened.

SUMMARY OF THE INVENTION

Thus, in view of the aforementioned circumstances, the present invention is intended to enhance the cigarette lighting ability of the cigarette lighter proposed previously through the use of a plurality of heaters- It is an object of the invention to obtain a safe and easy-to-light and easy-to-use cigarette lighter.

The present invention, which has been devised considering the above problems, provides a heater device for a cigarette lighter in which heaters are connected through a switching section to a power source section comprising dry cell batteries. When the switching section is closed, a closed circuit is formed to cause the heaters to generate heat. A cigarette allowed to come proximately in contact with the lighter is lit by the heat generated by the heaters. The heater device comprises a board having insulation properties together with heat resistance and fire resistance, and a plurality of heaters arranged on the periphery of the surface of the board abutting with a cigarette in a manner to be positioned in correspondence with the paper portion of the cigarette. The heaters are connected in series to each other, thereby solving the above problems.

Also, the present invention provides a method of manufacturing a heater device of a cigarette lighter comprising making a board a ceramic sintered material, comprising the steps of fusing an electrically-conductive metallic layer between the heater connecting ends and on the heater connecting terminal side of said board, then arranging the heaters and arranging a metallic material on the wire section of the heaters, and melt-fusing the metallic material to fix the heaters.

Further, the present invention provides a method of manufacturing a heater device of a cigarette lighter. A board of ceramic sintered material is provided. The method comprises the steps of arranging the heaters, whose connecting ends are connected to each other by a nickel bar-shaped material, on the board and arranging a powdered glass on the wire section of the heaters, and melt-fusing the glass to fix the heaters.

In the present invention, a plurality of heaters connected in series to each other are arranged on the board in correspondence with the paper portion of a cigarette. The easy to ignite paper portion of a cigarette is allowed to come proximately in contact with the heater device to be surely lit.

BRIEF DESCRIPTION OF THE DRAWINGS

FIGS. 6A and 6B show a method of manufacturing a heater device, in which FIG. 6A is an illustrative view showing the supply of a metallic material, and FIG. 6B is an illustrative view showing the support of a heater by the metallic material.

FIGS. 8A and 8B show another method of manufacturing a heater device, in which FIG. 8A is an illustrative view showing heaters, and FIG. 8B is an illustrative view showing a heater mounting state.

DETAILED DESCRIPTION OF THE PREFERRED EMBODIMENTS

On the basis of embodiments shown in FIGS. 1 through 8B, the present invention will be explained in detail hereinafter.

Figure 1:
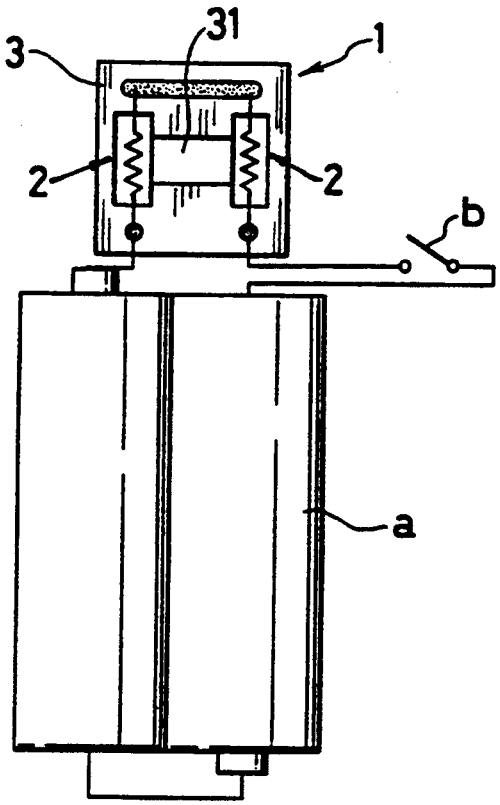
FIG. 1 is an illustrative view showing the connection of a cigarette lighter using an embodiment of a heater device in accordance with the present invention.
Figure 2:
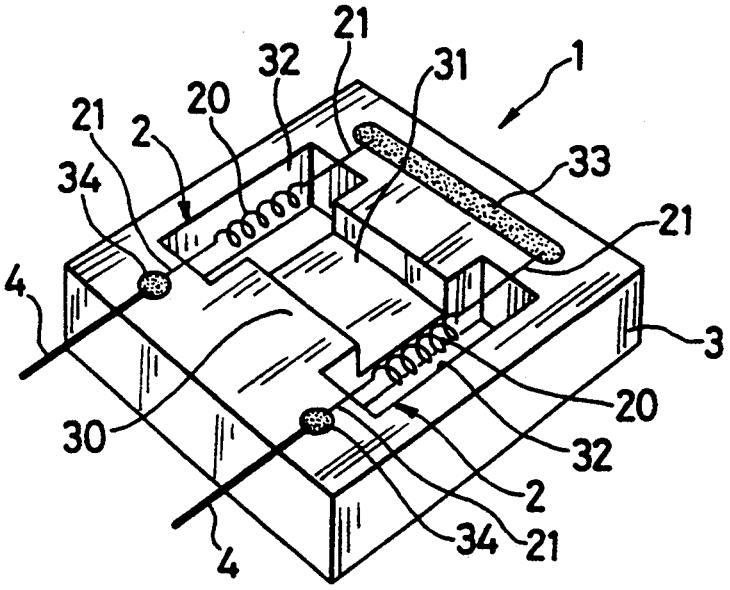
FIG. 2 is a perspective view showing an embodiment.
Figure 3:
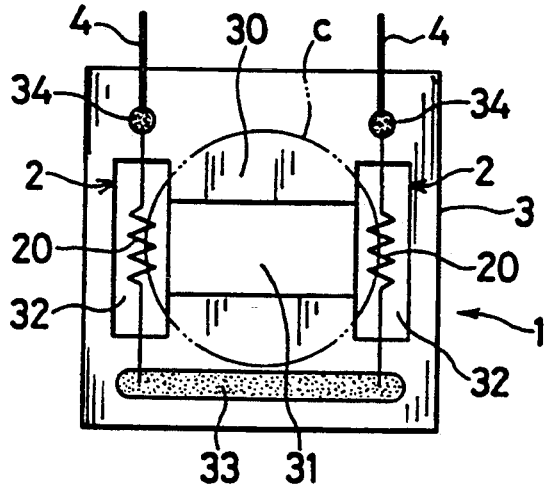
FIG. 3 is an illustrative view showing the top plan of an embodiment.
Figure 4:
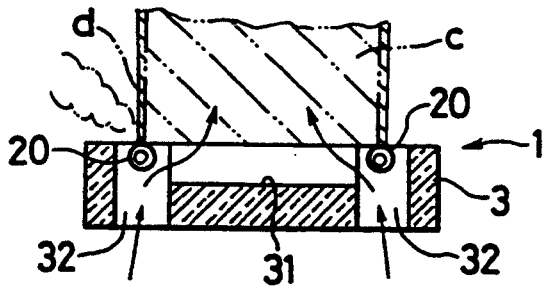
FIG. 4 is an illustrative view showing in section the state in which a cigarette is allowed to abut on a heater device in an embodiment.

FIG. 1 shows a basic construction of a cigarette lighter, in which heater device 1 is provided such that the device is connected through a switching section b to a power source section a comprising two R6 size (AA size) dry cell batteries, and when the switching section b is closed, a closed circuit is formed. The heater device 1 comprises two heaters 2, a board 3 having insulation properties together with heat resistance and fire resistance for supporting the heaters 2, and a pair of connecting terminals 4.

The board 3 has been molded from, for example, a ceramic material, and is provided with a concave portion 31 which is made in substantially H shape in the area ranging from the center onto the periphery of an abutting surface 30 on which the end face of a cigarette abuts, and with through holes 32 through which the concave portion penetrates to the back of the board on the periphery.

Each heater 2 is provided such that the heater is arranged on the portion of the through hole 32 in the concave portion 31 so as to be positioned on the periphery of the cigarette abutting surface 30 in a manner not to protrude beyond the abutting surface 30, thereby being positioned in correspondence with the paper portion of the cigarette. Particularly a heat generating coil section 20 of the heater 2 is positioned in correspondence with the paper portion. The heat generating coil section 20 is provided such that the section is supported in midair in a manner not to come in contact with the board 3, thereby not being crushed by cigarette abutting (preventing short circuit).

Wiring sections 33 and 34 are printed with an electrically conductive material, and an end of the each heater 2 is connected and fixed to the wiring section 33, while the other end of the heater 2 and the connecting terminal 4 are connected and fixed to the wiring section 34. The two heaters 2 are connected in series to each other.

Since the heater device 1 has the design previously described, a cigarette lighter is obtained by connecting the heater device 1 to the power source section a as shown in FIG. 1 so as to allow a power supply circuit to the heater 2 to be opened and closed when the switching section b is opened and closed. Closing the switching section b causes the power to be supplied to the heater device 1, whereby each heater 2 generates heat. Allowing a cigarette C to be abutted on the heaters 2 causes the paper portion d of the cigarette C to be placed against the heaters 2 and thus be heated, whereby the portion is lit. Particularly air is sucked when the cigarette C is lit, so that an air stream occurs which flows from the back of the board 3 through the through holes 32 and the center of the concave portion 31 on the abutting surface 30 into the cigarette C, whereby a large amount of oxygen is supplied to the heated portion (paper portion) and thus the portion is quickly and surely lit.

In the aforementioned embodiment, the heat generating coil section of the heaters 2 may be a small-sized one in which the number of turns is made fewer. That is, since two heaters 2 are connected in series to each other, the current value is low even for the power supplied from the power source section comprising two R6 size (AA size) dry cell batteries. Thus a heater having a small-sized heat generating coil section suitable for such current value may be used. The small-sized heat generating coil section rises in temperature to a value suitable for lighting, achieves an appropriate red-hot state, and more surely lights the paper portion, making the power consumption less. However, if the heaters having such small-sized heat generating coil section are connected in parallel, the current value in each heater would rise and then immediately the heaters burn out.

Figure 5:
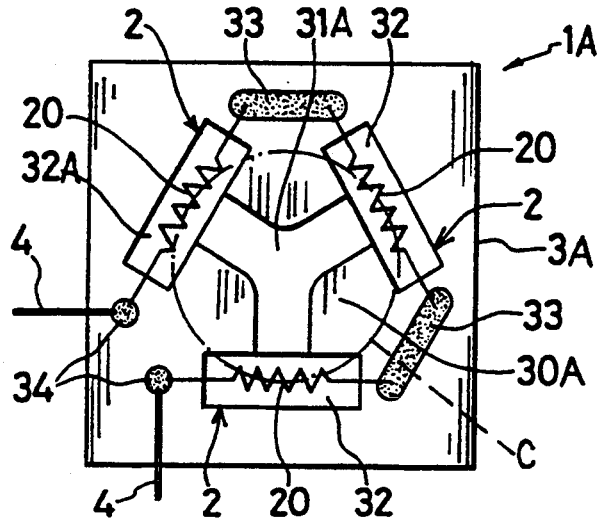
FIG. 5 is an illustrative view showing another embodiment.

Although the aforementioned embodiment employs two heaters, three heaters 3 connected in series to each other may be arranged on the periphery of the abutting surface 30 as shown in FIG. 5. On the board 3 side, in accordance with the arrangement, the concave portion 31 and the through holes 32 may be set.

Also, the abutting surface 30 may be set by the cigarette inserting port of a lighter assembly not shown, or set by the use of another member so that a cigarette is guided to the abutting surface, or set on a guide portion provided on the board itself.

Further, the through holes under the heaters are not always required, that is, a structure may be used which produces a stream supplying air to the paper side of a cigarette placed against the heaters, so that it is possible to employ a structure such that the concave portion on which the heaters are positioned extends to the edge side of the board.

Having been shown an example of the power source section comprising R6 size (AA size) dry cell batteries in the aforementioned embodiments, small-sized batteries such as R03 size (AAA size) and R1 size (N size) batteries suitable for carrying as with R6 size (AA size) dry cell batteries may be utilized without being limited to R6 size (AA size) dry cell batteries.

With respect to the manufacture of the aforementioned heater device 1, the board 3 preferably employs a ceramic sintered material with denseness properties. The ceramic sintered material has heat resistance such that its physical properties will not change because of a continuous safe service temperature 1500° C., and has an extremely low heat conductivity, so that the heater device 1 as previously described is very safe even when continuously used. Also, the ceramic sintered material is an insulating material by which a value of 10 Kv/mm is obtained. The material is hard, not corrosive and not water absorbent; and when discarded, it is safe and harmless.

Figure 6A:
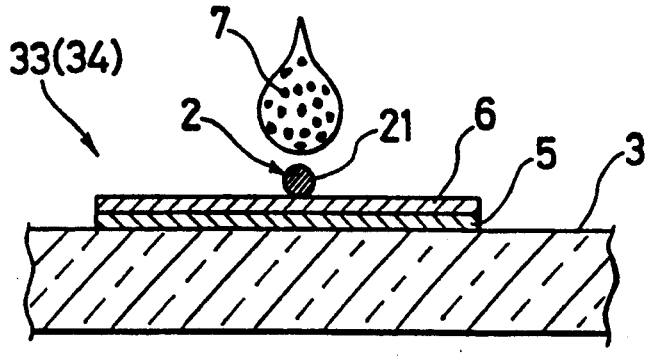
Figure 6B:
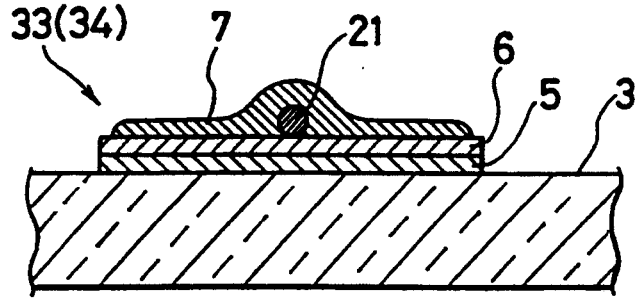

Thus, the manufacture of the heater device 1 in which the board 3 employs a ceramic sintered material with denseness properties is performed as follows. One of the methods of manufacturing the heater device 1 as shown in FIG. 6A and 6B comprises the following steps. A melt metal made of aluminum is sprayed between the heater connecting ends and on the heater connecting terminal side (that is, places on which said wiring sections 33 and 34 are provided) of the board 3 to provide a primary metallic layer 5. Next, a melt metal made of nickel is sprayed on that layer to form a metallic layer 6 for fusing. When the heater (platinum) 2 is arranged in such a manner that the wiring section 21 of the heater is positioned on the metallic layer 6 and an electrically conductive metallic material (for example, silver) 7 is arranged to correspond with the place between the heater connecting ends and with the heater connecting terminals in the field of the metallic layer 6 on the wiring section 21. The metallic material 7 is supplied to the wiring section 21 side as a printing ink containing the material.

Thereafter, the method further comprises the step of placing the heater device 1 into an oven to bake the device at a temperature of about 200° C. to allow the metallic material 7 to be melt-fused, thereby fixing the each heater 2.

In this manner, the wiring sections 33 and 34 are formed by the primary metallic layer 5, the metallic layer for fusing, and the metallic material thus melt-fused, whereby the heater device 1 is obtained which allows the heaters 2 to be supported by the wiring sections 33 and 34, respectively.

Figure 7:
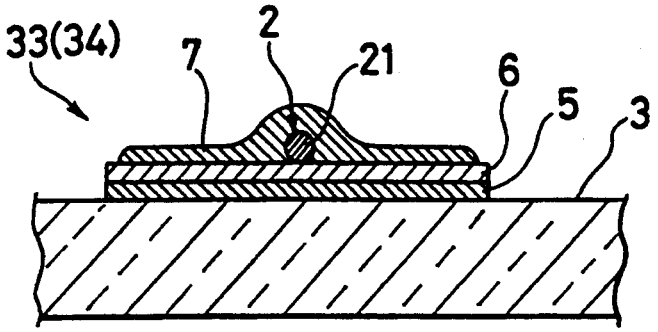
FIG. 7 is an illustrative view showing another method of manufacturing a heater device.

FIG. 7 shows an example in which the wiring sections 33 and 34 supporting the heaters 2 are formed by another method. In the example shown in FIG. 7, the method comprises the following steps. The portion forming the wiring sections 33 and 34 is printed with silver to provide the primary metallic layer 5. The layer is plated with nickel to provide the metallic layer 6 for fusing. As with the aforementioned method, this method further comprises the steps of arranging the wiring sections 21 of the heaters 2, supplying the metallic material 7, and placing the heater device 1 into an oven to bake the device to fix the heaters 2.

Figure 8A:
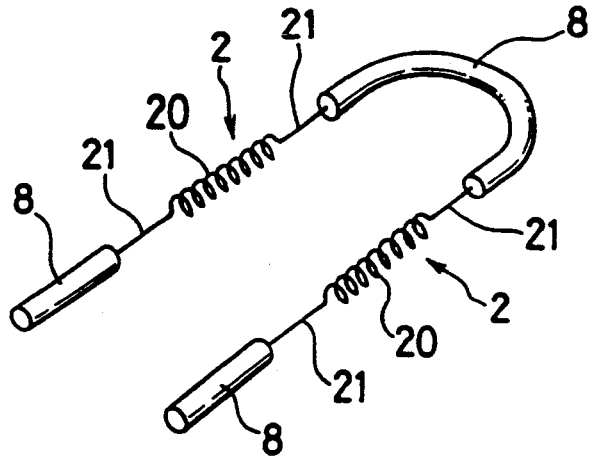
Figure 8B:
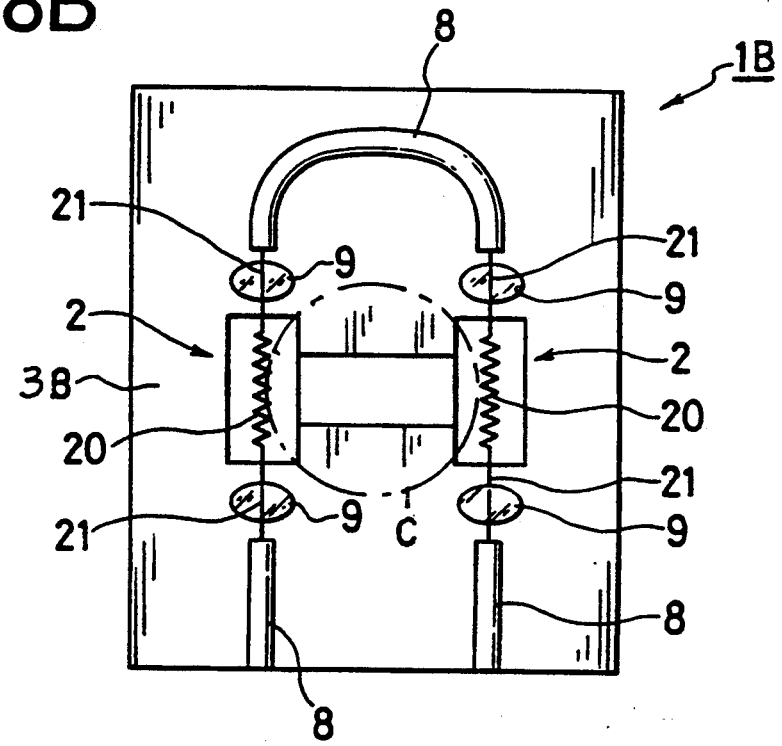

FIG. 8A and 8B show still another method comprising the following steps. The nickel bar-shaped material 8 is welded between the connecting ends of the plurality of the heaters 2 to connect the heaters 2 through the nickel bar-shaped material 8 to each other. The nickel bar-shaped material 8 is welded to the wiring section on the connecting terminal side of the heaters 2 on the end side thereof. Then the heaters 2, which have been connected to each other through the nickel bar-shaped material 8, and whose connecting terminals have been also connected with the nickel bar-shaped material 8, are arranged on the board 3 comprising the ceramic sintered material. A liquid comprising a glass powder and a binder is supplied to the wiring section of the heaters 2.

The method further comprises the step of placing the heater device 1 into an oven to bake the device to allow the glass supplied to the wiring section 21 to be melt-fused, thereby allowing the wiring section 21 of the heater 2 to be fixed by the glass 9 thus melt-fused. In this manner, as with the aforementioned methods, the board 3 on which the heaters are fixed is obtained.

A guide, though not shown, can be provided in order that the side edge of the paper portion of a cigarette is positioned in correspondence with the heaters 2. In that case, it suffices to mount a cylindrical member comprising also the ceramic sintered material with denseness properties to the heater device 1. Using the cylindrical guide member comprising the ceramic sintered material allows the heat generated when the paper portion is lit to be hardly conducted to the outside, thereby making the device safe.

According to the present invention, as previously described, in a cigarette lighter in which heaters are connected through a switching section to a power source section comprising dry batteries, and when the switching section is closed, a closed circuit is formed to cause the heaters to generate heat. A cigarette allowed to come proximately in contact with the heaters is lit by the heat generated by the heaters. A heater device of the cigarette lighter comprises a board having insulation properties together with heat resistance and fire resistance. A plurality of heaters arranged on the periphery of the surface of the board abuts a cigarette in a manner to be positioned in correspondence with the paper portion of the cigarette. The heaters are connected in series to each other.

This composition allows the easily ignited cigarette paper portion to be surely lit by the heater generating heat at a low current value. The cigarette lighting ability is to be improved and the life of small-sized dry cell batteries such as R6 size (AA size) batteries of the power source is to be extended, whereby more than the number of lightings of conventional take-along cigarette lighters into which gas fuel is filled (for example, 100-yen lighters) can be achieved by a portable cigarette lighter using two R6 size (AA size) dry batteries as a power source.

Also, making the heat generating coil section of each heater smaller causes the paper portion lighting ability to be further improved. Thus, such composition exhibits excellent effects on practicability such that the usability of the cigarette lighter is improved, and that the power consumption becomes less.

A method of manufacturing the heater device is employed such that heaters are fixed through metallic layers to the board comprising a ceramic sintered material by the use of a metallic material or a glass to be melt-fused. The method exhibits excellent effects on practicability such that the heaters can be surely fixed to the board comprising a ceramic sintered material. The heater device can be obtained which is excellent in heat resistance and durability utilizing the physical properties of the ceramic sintered material.

What is claimed is:

1. In a cigarette lighter having a heater device, the device comprising heaters and a switching section connecting the heaters to a power source section comprising dry cell batteries, such that when the switching section is closed, a closed circuit is formed to cause the heaters to generate heat, and such that a cigarette allowed to come proximately in contact with the heaters has the paper wrapping thereof lit by the heat generated by the heaters, the improvement comprising the heater device comprising a board having electrical insulation properties together with heat resistance and fire resistance, the board having a surface with a periphery and a plurality of the heaters being arranged spaced apart and on the periphery of the surface of the board positioned for substantially abutting the paper portion of the cigarette while generally avoiding the tobacco portion, and the spaced apart heaters being connected in series to each other.

2. In the cigarette lighter having a heater device as set forth in claim 1, the improvement further comprising the board has a concave portion provided on the area ranging from the center of the cigarette abutment surface onto the periphery thereof, the heaters being arranged in the concave portion in a manner so as not to protrude beyond the cigarette abutment surface, the heaters having heat generating coil portions and at least the heat generating coil portions of the heaters being supported in midair.

3. In the cigarette lighter having a heater device as set forth in claim 2, the improvement further comprising through holes penetrated to the lower side of the board at the heater arranged area of said concave portion.

* * * * *